US007051630B2

(12) United States Patent
Lee

(10) Patent No.: US 7,051,630 B2
(45) Date of Patent: May 30, 2006

(54) INSULATED MAGNETIC SCREWDRIVER

(76) Inventor: Young Man Lee, 252-1602, Olympic-Sunsu-Kizachon-Apt., 89, Bangi-Dong, Songpa-Ku, Seoul, 138-050 (KR)

( * ) Notice: Subject to any disclaimer, the term of this patent is extended or adjusted under 35 U.S.C. 154(b) by 47 days.

(21) Appl. No.: 10/494,164

(22) PCT Filed: Aug. 1, 2003

(86) PCT No.: PCT/KR03/01553

§ 371 (c)(1),
(2), (4) Date: Apr. 27, 2004

(87) PCT Pub. No.: WO2004/082893

PCT Pub. Date: Sep. 30, 2004

(65) Prior Publication Data

US 2005/0235787 A1 Oct. 27, 2005

(30) Foreign Application Priority Data

Mar. 21, 2003 (KR) ..... 20-2003-0008546 U

(51) Int. Cl.
*B25B 23/00* (2006.01)

(52) U.S. Cl. ..... 81/900; 81/451; 81/436

(58) Field of Classification Search ..... 81/438, 81/451, 900, 436

See application file for complete search history.

(56) References Cited

U.S. PATENT DOCUMENTS 1,587,647 A * 6/1926 Hood et al. ..... 81/438
2,260,055 A * 10/1941 Reardon ..... 81/451
2,671,484 A * 3/1954 Clark ..... 81/451
2,782,822 A * 2/1957 Clark ..... 81/451
2,782,823 A * 2/1957 Williams, Jr. ..... 81/451
2,808,862 A * 10/1957 Simkins ..... 81/442
2,838,082 A * 6/1958 Lange ..... 81/438
3,392,767 A * 7/1968 Stillwagon, Jr. ..... 81/451
4,736,658 A * 4/1988 Jore ..... 81/451
5,259,277 A * 11/1993 Zurbuchen ..... 81/177.1
5,309,799 A * 5/1994 Jore ..... 81/451
5,458,030 A * 10/1995 Betts ..... 81/451
5,638,727 A * 6/1997 Gringer ..... 81/438
5,782,149 A * 7/1998 Jensen ..... 81/125
6,148,699 A * 11/2000 Han ..... 81/451
6,154,108 A * 11/2000 Huang ..... 335/284

(Continued)

FOREIGN PATENT DOCUMENTS

JP 58-169963 11/1983

(Continued)

*Primary Examiner*—David B. Thomas
(74) *Attorney, Agent, or Firm*—Park Law Firm; John K. Park

(57) ABSTRACT

Disclosed is an insulated magnetic screwdriver, including a shank having a tip at an end or each end thereof and a peripheral groove formed around a central portion thereof so that the central portion of the shank has a diameter smaller than that of each end thereof, a handle having a locking recess into which the shank is fitted and fixedly or detachably locked thereto, an insulator mounted rotatably around the peripheral groove of the shank while having the same circumference to the shank; and a cylindrical magnet mounted around the peripheral groove of the shank to have the same circumference to the shank while being positioned at an end or each end of the insulator to magnetize the tip. Practically, a current-charged screw in a deep narrow hole can be easily loosened or firmly tightened by means of the inventive screwdriver, without the risk to electric shock.

3 Claims, 4 Drawing Sheets

U.S. PATENT DOCUMENTS

| | | | | |
|---|---|---|---|---|
| 6,408,723 | B1 * | 6/2002 | Zurbuchen | 81/119 |
| 6,427,563 | B1 * | 8/2002 | Zurbuchen et al. | 81/177.1 |
| 6,530,299 | B1 * | 3/2003 | Liu | 81/451 |
| 6,655,240 | B1 * | 12/2003 | DeVecchis et al. | 81/438 |

FOREIGN PATENT DOCUMENTS

| | | |
|---|---|---|
| JP | 2-85567 | 7/1990 |
| KR | 89-6530 | 5/1989 |

* cited by examiner

INSULATED MAGNETIC SCREWDRIVER

TECHNICAL FIELD

The present invention relates to an insulated magnetic screwdriver, by which a voltage-charged screw can be easily loosened or securely tightened without the risk of electric shock.

BACKGROUND ART

Korean Patent Application No. 20-2001-0030997 discloses a safe screwdriver equipped with an insulating part (hereinafter, referred to as a 'conventional screwdriver'), filed by the inventor of the present invention on Oct. 11, 2001.

Referring to FIG. 1, there is shown a perspective view of a conventional screwdriver. FIG. 2 is a sectional view taken along the line A—A of FIG. 1.

As shown in FIGS. 1 and 2, the conventional screwdriver includes a handle 1, a shank 2 having a cross-headed tip or a flat tip 2*a* formed at an end or each end thereof. The shank 2 has a peripheral groove 2*b* formed around a central portion thereof, so that the central portion of the shank 2 has a diameter smaller than that of each end of the shank 2. Further, an insulator 3 is rotatably mounted around the peripheral groove 2*b* of the shank 2.

As such, the insulator 3, which is mounted around the peripheral groove 2*b*, has the same circumference to the shank 2, and thus a junction between the insulator 3 and the shank 2 is formed to be smooth.

Moreover, the insulator 3 is installed at a fine interval from the peripheral groove 2*b* of the shank 2 so that the shank 2 can be easily rotated in the insulator 3.

At a terminal end of the handle 1, a locking recess 1*a* is formed, into which the shank 2 is inserted and then fixedly or detachably locked to the handle 1.

That is, in cases where the tip 2*a* is formed only at a first end of the shank 2, a second end of the shank 2 is inserted into the locking recess 1*a* of the handle 1 and then fixedly locked to the handle 1. Meanwhile, when the tip 2*a* is formed at each end of the shank 2, any tip 2*a* may be inserted into the locking recess 1*a* of the handle 1 for selective use, and detachably locked to the handle 1.

The end of the shank 2, which is not surrounded by the insulator 3, is fitted into the locking recess 1*a*, and the shank 2 may be rotated in the insulator 3.

Since a user can grip the shank 2 by using the insulator 3, a charged screw may be safely loosened or tightened without the risk of electric shock.

In addition, the insulator 3 is formed in the same shape as the shank 2, and thus the shank 2 can be smoothly inserted into a deep, narrow hole, so that the screw in the hole is easily tightened or loosened (FIG. 5).

However, even though the screw in the hole is loosened, because a head of the screw is not externally exposed, it is difficult to completely remove the loosened screw from the hole by means of the conventional screwdriver.

To remove such a loosened screw from the hole, there is additionally required an insulated drill or a pincette. But, this is too involved.

Conversely, when the screw is inserted into the hole for fixing, it cannot be set in an accurate position due to the risk of electric shock.

DISCLOSURE OF THE INVENTION

Therefore, it is an aspect of the present invention to alleviate the problems encountered in the related art and to provide an insulated magnetic screwdriver, characterized in that a magnetic material is used to exhibit a magnetic force at a tip of a shank of the screwdriver, as well as to easily and reliably loosen or firmly tighten a voltage-charged screw positioned in a deep, narrow hole, whereby the screw can be safely removed from the hole or accurately inserted again into the hole.

Another aspect of the present invention is to provide an insulated magnetic screwdriver, characterized in that a metal ring is further mounted into a handle of the screwdriver, whereby the shank can be detachably locked to the handle by a magnetic force of a magnetic material.

To accomplish the above aspects, there is provided an insulated magnetic screwdriver, including a shank having a tip at an end or each end thereof, and a peripheral groove formed around a central portion thereof so that the central portion of the shank has a diameter smaller than that of each end thereof, a handle having a locking recess into which the shank is fitted and fixedly or detachably locked thereto, an insulator mounted rotatably around the peripheral groove of the shank while having the same circumference to the shank, and a cylindrical magnet mounted around the peripheral groove of the shank to have the same circumference to the shank while being positioned at an end or each end of the insulator to magnetize the tip.

As for the insulated magnetic screwdriver, the shank is fitted into the locking recess of the handle, together with the cylindrical magnet surrounding the peripheral groove at each end of the insulator, and the locking recess is installed with a metal ring magnetically combined with the cylindrical magnet so that the shank is detachably locked to the handle.

BRIEF DESCRIPTION OF THE DRAWINGS

The above and other aspects, features and other advantages of the present invention will be more clearly understood from the following detailed description taken in conjunction with the accompanying drawings, in which.

BEST MODE FOR CARRYING OUT THE INVENTION

Below, a detailed description will be given of an insulated magnetic screwdriver according to preferred embodiments of the present invention, in conjunction with the appended drawings.

Figure 1:
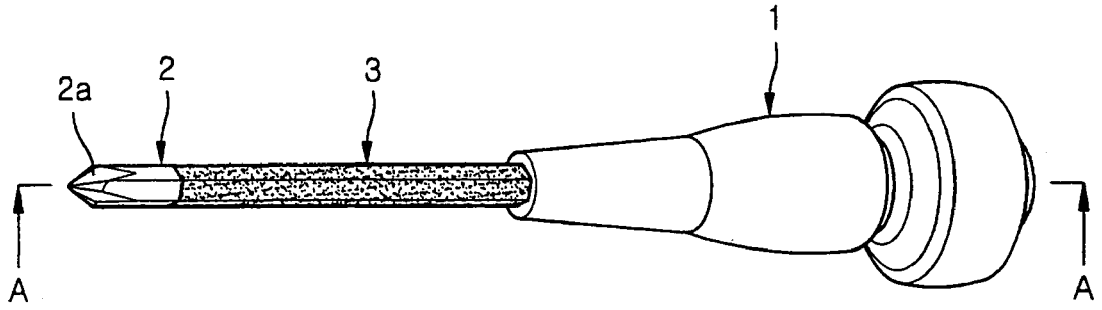
Fig. 1 Prior Art
FIG. 1 is a perspective view of a conventional screwdriver.
Figure 2:
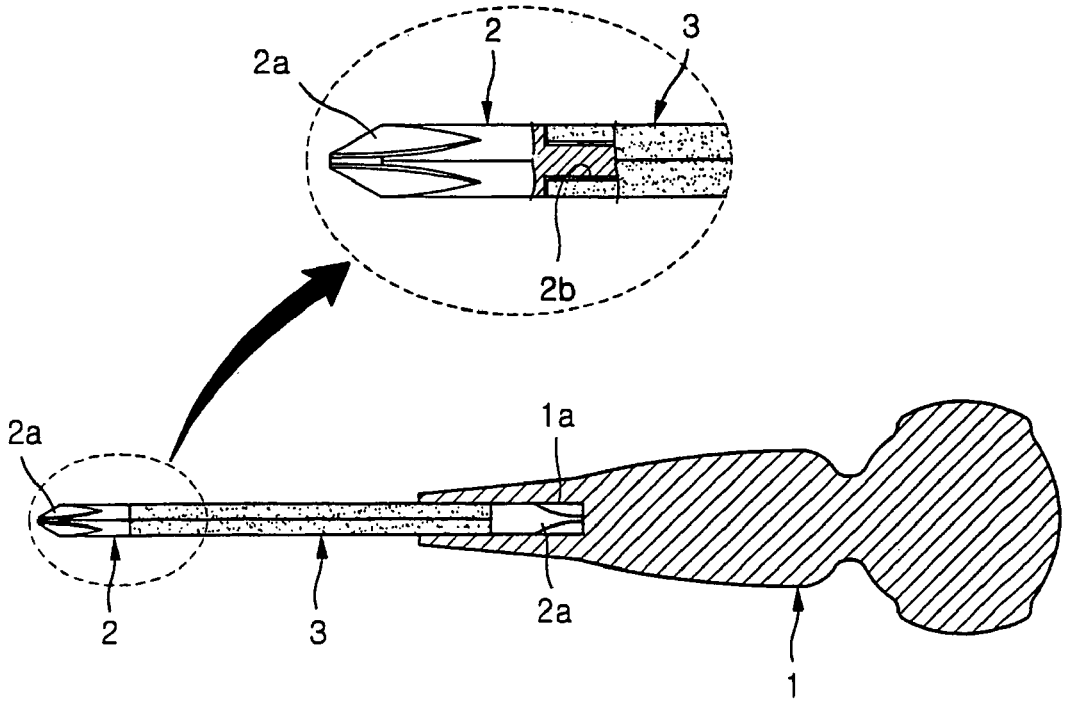
Fig. 2 Prior Art
FIG. 2 is a sectional view taken along the line A—A of FIG. 1.
Figure 3:
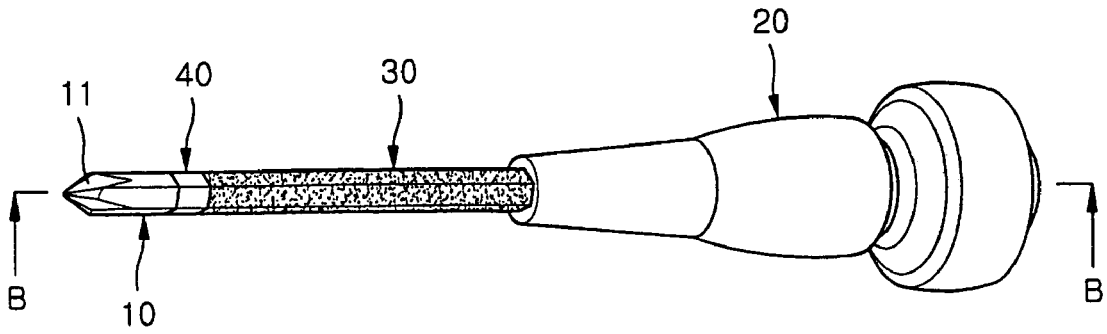
FIG. 3 is a perspective view of an insulated magnetic screwdriver according to a first embodiment of the present invention.

With reference to FIG. 3, there is shown a perspective view of an insulated magnetic screwdriver according to a first embodiment of the present invention. A sectional view of the insulated magnetic screwdriver taken along the line B—B of FIG. 3 is shown in FIG. 4.

Figure 4:
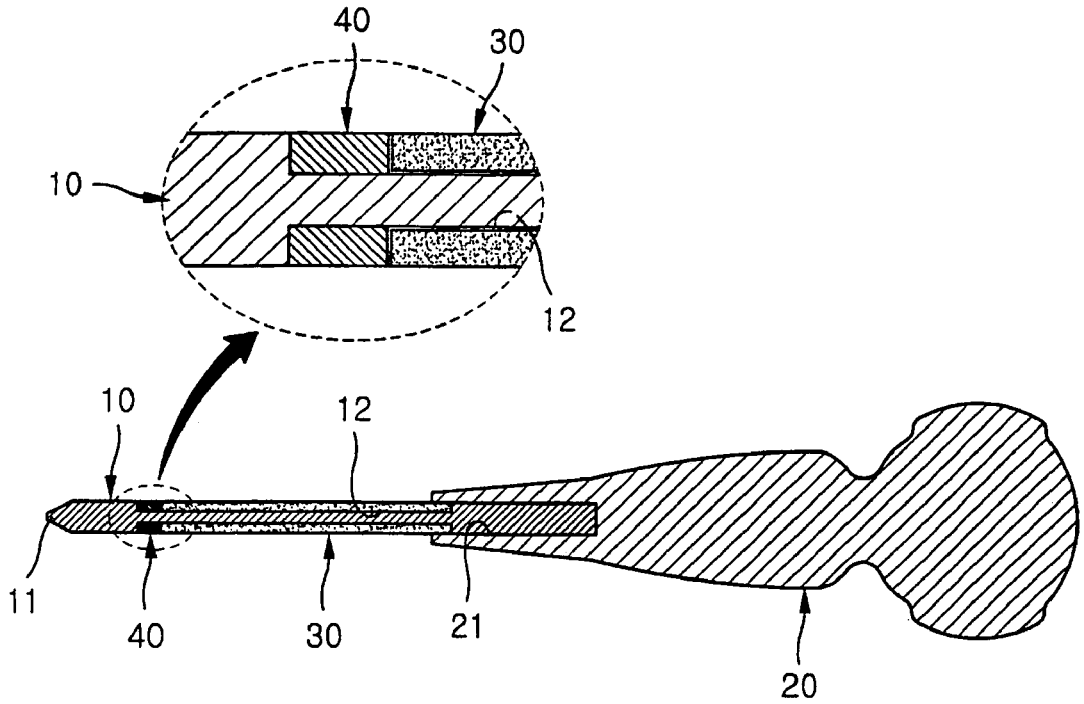
FIG. 4 is a sectional view taken along the line B—B of FIG. 3.

As shown in FIGS. 3 and 4, the screwdriver includes a shank 10 made of steel, in which a first end of the shank 10 is made to form a cross-headed tip or a flat tip 11 that is fitted into a cross-slot or a single-slot of a head of a screw to tighten or loosen the screw. In addition, the shank 10 has a peripheral groove 12 formed around a central portion thereof so that the central portion of the shank 10 has a diameter smaller than that of each end thereof.

The shank 10 is locked to a handle 20 made of a synthetic resin at a second end thereof, by inserting the second end of the shank 10 into a locking recess 21 formed in a terminal end of the handle 20.

Further, the handle 20 is integrally produced along with the shank 10 by an injection molding process, to achieve a firm locking therebetween.

To loosen or tighten a voltage-charged screw, it is necessary for an insulator 30 having a thickness of 0.1–7 mm (depending on the voltage), which is mounted around the peripheral groove 12 of the shank 10. Thereby, a user can grip the shank 10.

The insulator 30 is formed to have the outer appearance and circumference same to the shank 10.

As shown in FIG. 3, if the shank 10 is formed in a hexagonal cross-section, the insulator 30 has a hexagonal cross-section with the same size to the shank 10.

When the user grips the insulator 30, only the shank 10 in the insulator 30 is rotated while the insulator 30 is not moved. In other words, the insulator 30 is installed at a very fine interval (about 0.1 mm) from the peripheral groove 12 of the shank 10 to prevent the application of friction to the hand of the user that grips the insulator 30. For this, it is preferred that the peripheral groove 12 has a circular cross-section.

As for the insulator 30, any material may be used so long as it has an insulating function. Preferably, voltage-insulating materials, such as ceramics or polyester, are used.

Alternatively, though being not shown in FIGS. 3 and 4, the insulator 30 may be subjected to knurling treatment on a surface thereof for sliding prevention.

In particular, various decorative patterns may be engraved onto the surface of the insulator 30.

In the present invention, a cylindrical magnet 40 is further installed around the peripheral groove 12 of the shank 10 while being positioned at an end of the insulator 30.

The cylindrical magnet 40 functions to magnetize the tip 11 of the shank 10, and, as necessary, to attach the screw to the tip 11. Specifically, the cylindrical magnet 40 is mounted around the peripheral groove 12 at the end of the insulator 30 toward the tip 11 of the shank 10, whereby it is disposed to be adjacent to the tip 11.

Further, the cylindrical magnet 40 is formed to have the same circumference to the shank 10 as in the insulator 30, so as to obtain a smooth junction between the cylindrical magnet 40 and the shank 10.

Such a cylindrical magnet 40 may comprise any material, provided that it has a magnetic force to the extent that the screw attached to the tip 11 is easily separated from the tip 11 by the user.

In the first embodiment, the peripheral groove 12 of the shank 10 is completely surrounded by the insulator 30 and the cylindrical magnet 40, so that the circumferential surface of the shank 10 has no protrusions. In addition, when the shank 10 is locked to the handle 20, a part of the insulator 30 is inserted into the locking recess 21 of the handle 20. Thereby, the shank 10 covers up with the exception of the tip portion thereof.

Figure 5:
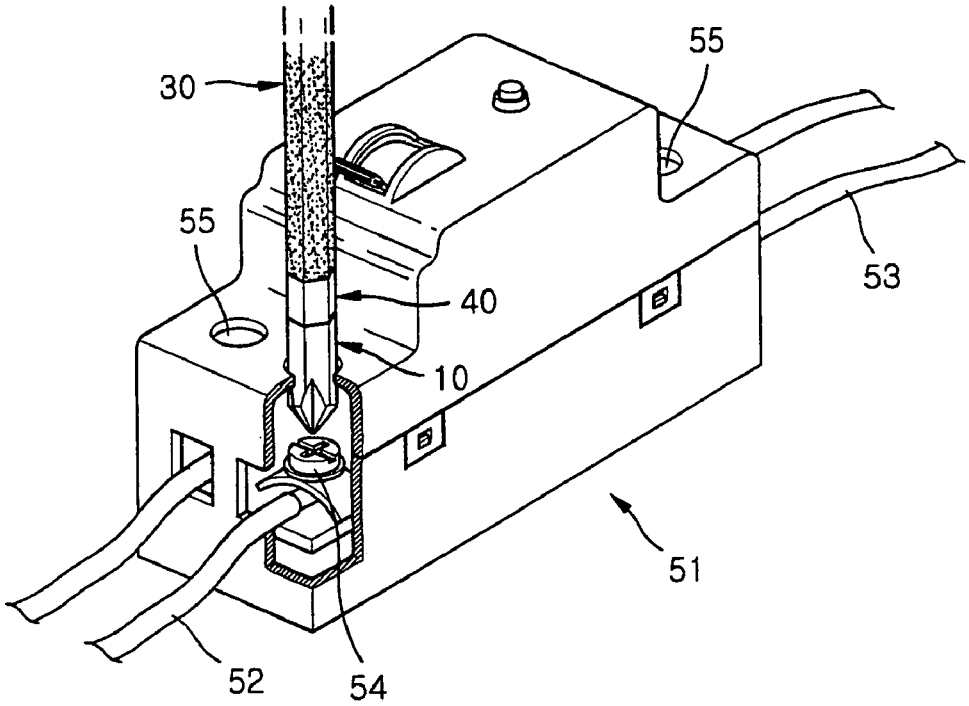
FIG. 5 is a perspective view illustrating the operation of the insulated magnetic screwdriver according to the first embodiment.

FIG. 5 illustrates the operation of the insulated magnetic screwdriver according to the first embodiment.

In FIG. 5, the reference numeral 51 designates an earth leakage breaker, to which a power side wire 52 and a load side wire 53 are electrically connected each by a connection screw 54. Since the connection screw 54 is charged with voltage, it is disposed into a deep, narrow hole 55 to prevent electric shock from occurring.

In cases where the connection screw 54 is loosened for repair or inspection of the earth leakage breaker 51, the shank 10 is inserted into the hole 55 and the tip 11 of the shank 10 is fitted into slots of the head of the connection screw 54.

The hole 55 is typically formed to be larger in a diameter than that of the head of the screw 54. However, in the present invention, since the insulator 30 and the cylindrical magnet 40 are formed to be same as the circumference of the shank 10, the user can easily insert the shank 10 into the hole 55, regardless of the diameter of the hole 55.

If the outer diameter of the insulator 30 or the cylindrical magnet 40 is larger than that of the shank 10, the shank 10 having the insulator 30 and the cylindrical magnet 40 cannot be inserted into the hole 55 and it is almost impossible to repair or inspect the earth leakage breaker 51. Otherwise, when the shank 10 having the insulator 30 and the cylindrical magnet 40 is inserted into the hole 55, the insulator 30 or the cylindrical magnet 40 which is thicker than the shank 10 may be caught by the top edge of the hole 55, thus degrading work efficiency while repairing or inspecting the earth leakage breaker 51.

Upon the work, the user grips the insulator 30 by one hand thereof and rotates the handle 20 by the other hand, thereby completely loosening the connection screw 54.

At this time, the user can strongly grip the shank 10 covered with the insulator 30 and thus loosen the connection screw 54 charged with voltage.

When the shank 10 is removed from the hole 55, the connection screw 54 is in the state of being attached to the tip 11 magnetized by the cylindrical magnet 40.

Since the hole 55 is formed to be deep, the head of the connection screw 54 is not externally exposed even though the connection screw 54 is completely loosened. However, in the present invention, since the connection screw 54 may be attached to the tip 11 of the shank 10 by the cylindrical magnet 40, the user can easily remove the connection screw 54 from the hole 55 without the risk to electric shock.

Thereafter, when the connection screw 54 is connected again by completing the repair and inspection of the earth leakage breaker 51, the shank 10 is inserted into the hole 55 as the connection screw 54 is attached to the tip 11 of the shank 10. Then, the shank 10 is rotated, whereby the connection screw 54 is firmly tightened.

As such, the user can insert the connection screw 54 into the hole 55 without the risk to electric shock, and thus a connection process can be performed in the state of the screw 54 being set in an accurate position.

Figure 6:
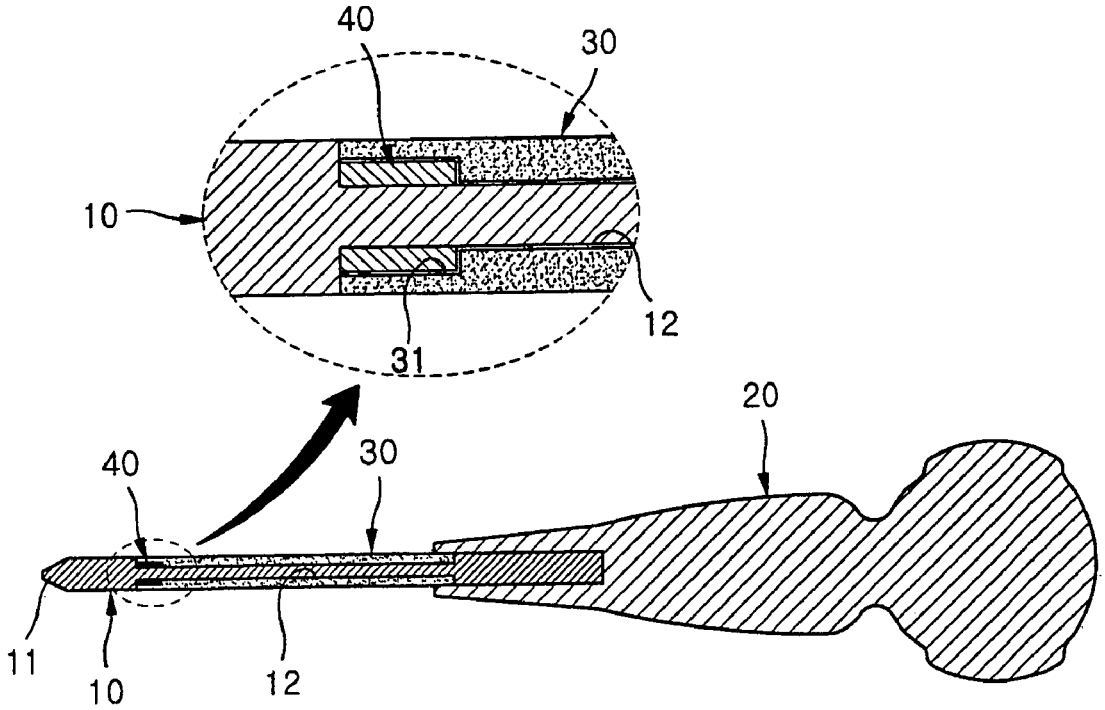
FIG. 6 is a sectional view of an insulated magnetic screwdriver according to a second embodiment of the present invention.

Turning now to FIG. 6, there is shown a sectional view of an insulated magnetic screwdriver according to a second embodiment of the present invention.

Other structures and operations of the second embodiment illustrated in FIG. 6 remain the same as in the first embodiment, with the exception of structures of an insulator 30 and a cylindrical magnet 40.

In the second embodiment, the insulator 30 has a receiving recess 31 positioned toward a tip 11 of a shank 10. The cylindrical magnet 40 that surrounds a peripheral groove 12 of the shank 10 is wholly fitted into the receiving recess 31 of the insulator 30.

The cylindrical magnet 40 is cylindrically formed, and positioned at a fine interval (about 0.1 mm) from the receiving recess 31 of the insulator 30, so that the shank 10 is rotated in the insulator 30.

The peripheral groove 12 of the shank 10 is smoothly surrounded by the insulator 30 so as not to form unnecessary protrusions around the shank 10.

Since the cylindrical magnet 40, fitted into the receiving recess 31 of the insulator 30, is not externally exposed, the risk of electric shock caused by touching the hand gripping the insulator 30 to the cylindrical magnet 40 or damage of the cylindrical magnet 40 by external impact can be reduced in the course of loosening or tightening the charged screw.

Figure 7:
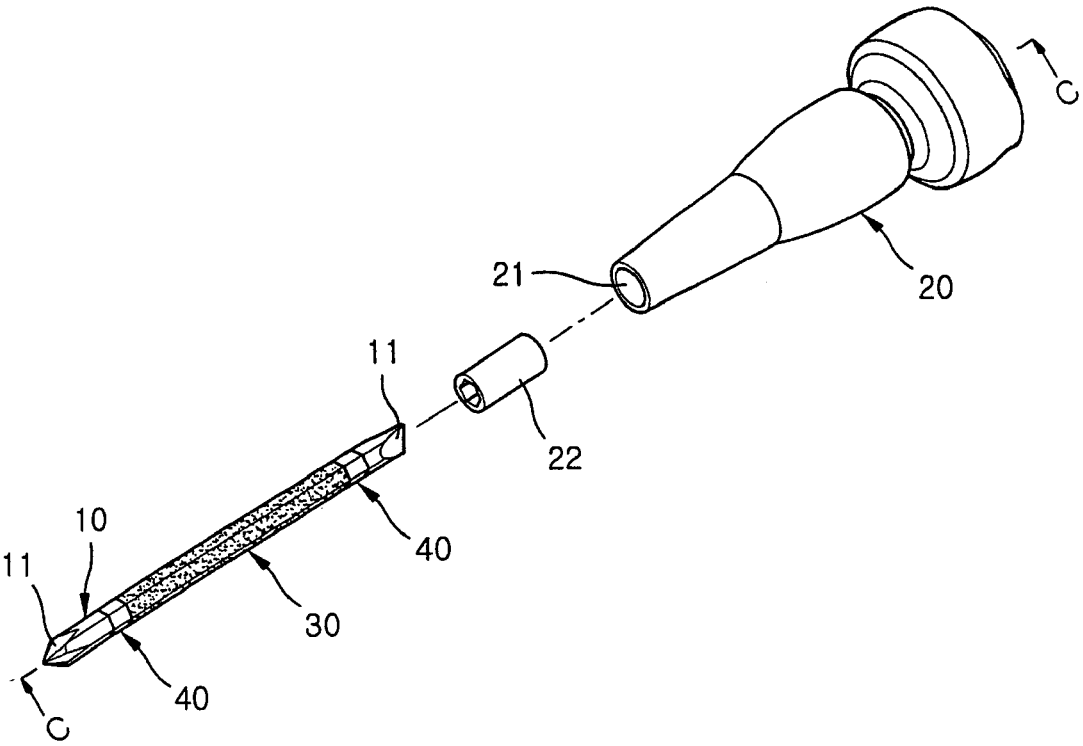
FIG. 7 is an exploded perspective view of an insulated magnetic screwdriver according to a third embodiment of the present invention.
Figure 8:
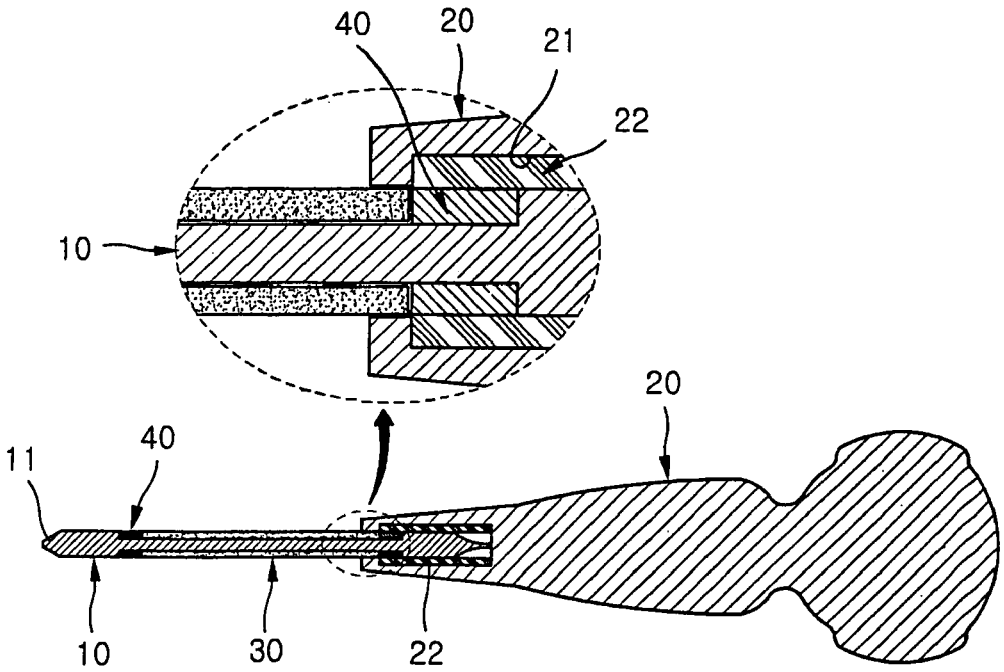
FIG. 8 is a sectional view taken along the line C—C of FIG. 7.

On the other hand, FIG. 7 is an exploded perspective view of an insulated magnetic screwdriver according to a third embodiment of the present invention. FIG. 8 is a sectional view taken along the line C—C of FIG. 7.

Other structures and operations of the third embodiment illustrated in FIGS. 7 and 8 remain the same as in the first embodiment, with the exception of a tip 11 formed at each end of a shank 10 and then magnetized, and a locking structure of the shank 10 and a handle 20.

The shank 10 has a tip 11 at each end thereof, and a cylindrical magnet 40 which is disposed to each end of an insulator 30 is used to surround a peripheral groove 12 of the shank 10 and functions to magnetize the tip 11 adjacent thereto.

As such, the peripheral groove 12 of the shank 10 is completely surrounded by the insulator 30 and the cylindrical magnet 40.

As for the tip 11 positioned at each end of the shank 10, a first tip 11 may be a cross-headed type and a second tip 11 may be a flat type as in FIG. 7. Otherwise, both tips 11 may have the same cross-headed types or flat types, provided that the tips 11 have different sizes.

Further, a metal ring 22 is fitted into a locking recess 21 of a handle 20, and firmly fixed by use of an adhesive or is integrated with the handle 20.

In such a case, any tip 11 of the shank 10 and the cylindrical magnet 40 adjacent thereto are fitted together into the metal ring 22.

Additionally, it is preferable that a part of the insulator 30 may be inserted into the metal ring 22 of the handle 20, as in the first embodiment.

When the shank 10 is fitted into the locking recess 21 of the handle 20, the cylindrical magnet 40 is mutually combined with the metal ring 22 of the handle 20 by a magnetic force, whereby the shank 10 is detachably locked to the handle 20.

Hence, the user may easily fit the shank 10 into the locking recess 21 of the handle 20 or separate the shank 10 from the handle 20.

Further, the shank 10 and the metal ring 22 are formed to be equivalently angled so that the shank 10 is not separately rotated with the handle 20. Also, a fine gap is formed between the insulator 30 and the locking recess 21 so that the insulator 30 partially fitted into the locking recess 21 of the handle 20 is rotatably moved in the locking recess 21.

The metal ring 22 is made of any metal, with the exception of non-iron metals.

In the third embodiment, the tip 11 is formed at each end of the shank 10, and the shank 10 is detachably locked to the handle 20. Thereby, the tip 11 can be selectively used for desired purposes.

INDUSTRIAL APPLICABILITY

As described above, the present invention provides an insulated magnetic screwdriver, characterized in that an insulator is mounted around a peripheral groove of a shank to have the same shape as the shank, whereby the screwdriver can be smoothly inserted into a deep narrow hole. Thus, a voltage-charged screw positioned in the hole can be reliably loosened or tightened. In addition, a cylindrical magnet is installed around the peripheral groove of the shank so as not to be thicker than the shank, to magnetize a tip of the shank. Therefore, a loosened screw may be magnetically attached to the tip of the shank, magnetized by the cylindrical magnet, and easily and reliably removed from the hole without the risk to electric shock.

On the contrary, when the screw is inserted into the hole for fixing, it can be easily and reliably set in an accurate position without the risk to electric shock.

Further, since the cylindrical magnet is mounted around the peripheral groove as being fitted into a receiving recess of the insulator, the cylindrical magnet is not externally exposed. Hence, when a charged screw is loosened or tightened, undesired electric shock caused by coming into contact with the cylindrical magnet can be prevented. Also, the cylindrical magnetic sheet magnet may be protected from external impact.

Moreover, because a metal ring is installed to a locking recess of a handle, the shank can be detachably locked to the handle by a magnetic force of the cylindrical magnet. Thereby, locking and separation between the shank and the handle can be easily performed.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An insulated magnetic screwdriver, comprising:

a shank having a tip at at least one of both ends thereof, and a peripheral groove formed around a central portion thereof so that the central portion of the shank has a diameter smaller than that of each end thereof;

a handle having a locking recess into which the shank is fitted and fixedly or detachably locked thereto;

an insulator mounted rotatably around the peripheral groove of the shank while having the same circumference to the shank; and a cylindrical magnet mounted around the peripheral groove of the shank to have the same circumference to the shank while being positioned at at least one of both ends of the insulator to magnetize the tip of the shank, wherein the cylindrical magnet magnetizes the tip of the shank for magnetically attracting a metal piece around the tip of the shank.

2. The screwdriver as defined in claim 1, wherein the insulator has a receiving recess at at least one of both ends thereof, and the cylindrical magnet is mounted around the peripheral groove of the shank as being fitted into the receiving recess of the insulator.

3. The screwdriver as defined in claim 1, wherein the shank is fitted into the locking recess of the handle, together with the cylindrical magnet surrounding the peripheral groove of the shank at each end of the insulator, and the locking recess of the handle is installed with a metal ring magnetically combined with the cylindrical magnet so that the shank is detachably locked to the handle.

* * * * *